US009322624B2

(12) United States Patent
Alford et al.

(10) Patent No.: US 9,322,624 B2
(45) Date of Patent: Apr. 26, 2016

(54) EXPLOSIVES

(75) Inventors: Sidney Alford, Corsham (GB); Roland Alford, Box (GB)

(73) Assignee: Alford Research Limited, Wiltshire (GB)

( * ) Notice: Subject to any disclaimer, the term of this patent is extended or adjusted under 35 U.S.C. 154(b) by 0 days.

(21) Appl. No.: 13/320,908

(22) PCT Filed: Jun. 14, 2010

(86) PCT No.: PCT/GB2010/001158

§ 371 (c)(1),
(2), (4) Date: Jan. 10, 2012

(87) PCT Pub. No.: WO2010/146340

PCT Pub. Date: Dec. 23, 2010

(65) Prior Publication Data

US 2012/0097015 A1 Apr. 26, 2012

(30) Foreign Application Priority Data

Jun. 15, 2009 (GB) ..... 0910323.5

(51) Int. Cl.

| | |
|---|---|
| ***F42B 33/06*** | (2006.01) |
| ***F42B 3/00*** | (2006.01) |
| ***F42B 3/22*** | (2006.01) |
| ***F41B 9/00*** | (2006.01) |
| ***F42D 5/04*** | (2006.01) |

(52) U.S. Cl.

CPC ..... *F42B 33/062* (2013.01); *F41B 9/0046* (2013.01); *F42B 3/00* (2013.01); *F42B 3/22* (2013.01); *F42D 5/04* (2013.01)

(58) Field of Classification Search

CPC ..... F41B 9/0043; F41B 9/0046; F41B 9/00; F42B 33/062; F42B 3/00; F42B 3/22; F42B 33/06; F42D 5/04

USPC ..... 102/302, 305, 306, 307, 308, 309, 310, 102/475, 476, 331; 86/50

See application file for complete search history.

(56) References Cited

U.S. PATENT DOCUMENTS

| | | | | |
|---|---|---|---|---|
| 3,190,219 | A | 6/1965 | Venghiattis | |
| 4,615,271 | A * | 10/1986 | Hutchinson | 102/318 |
| H0000161 | H * | 11/1986 | Sullivan, Jr. | 102/363 |
| 4,905,601 | A * | 3/1990 | Gabriel et al. | 102/307 |
| 4,955,939 | A * | 9/1990 | Petrousky et al. | 102/476 |

(Continued)

FOREIGN PATENT DOCUMENTS

| | | |
|---|---|---|
| CA | 2643642 | 6/2009 |
| CN | 201007199 | 1/2008 |

(Continued)

OTHER PUBLICATIONS

Written Opinion of the International Searching Authority for PCT/GB2010/001158; Dec. 15, 2011.*

(Continued)

*Primary Examiner* — James S Bergin
(74) *Attorney, Agent, or Firm* — Kilpatrick Townsend & Stockton LLP; Dean W. Russell

(57) ABSTRACT

A liquid-jacketed disrupter comprising a container (101) for receiving liquid and housing a receptacle (120) for explosive material, in which the container comprises one or more indentations (115) which result in the generation of liquid jets upon detonation.

19 Claims, 6 Drawing Sheets

(56) References Cited

U.S. PATENT DOCUMENTS

| | | | | |
|---|---|---|---|---|
| 5,170,004 | A * | 12/1992 | Garrison | 89/1.14 |
| 6,269,725 | B1 | 8/2001 | Cherry | |
| 6,405,627 | B1 * | 6/2002 | Anderson | 89/1.13 |
| 6,584,908 | B2 * | 7/2003 | Alford | 102/302 |
| 7,299,735 | B2 * | 11/2007 | Alford | 89/1.13 |
| 8,091,479 | B1 * | 1/2012 | Jakaboski et al. | 102/306 |
| 2002/0096079 | A1 * | 7/2002 | Alford | 102/475 |
| 2004/0112241 | A1 | 6/2004 | Alford | |
| 2010/0018427 | A1 * | 1/2010 | Roland et al. | 102/305 |

FOREIGN PATENT DOCUMENTS

| | | |
|---|---|---|
| WO | 03/058155 | 7/2003 |
| WO | 2006/034528 | 4/2006 |
| WO | 2007/099362 | 9/2007 |

OTHER PUBLICATIONS

H. Xie, et al. "Experimental Study of Complex Slotted Charge Blasting," Blasting, vol. 23, No. 1, Mar. 2006, pp. 8-12.

English Translation of "Text Portion of the Notification of the First Office Action" in Chinese Patent Application No. 201080026507.4 (three pages).

European Patent Application No. 10 736 758.3, Examination Report mailed May 6, 2015, 6 pages.

* cited by examiner

EXPLOSIVES

CROSS REFERENCE TO RELATED APPLICATIONS

This application is the U.S. national phase of International Application No. PCT/GB2010/001158 filed on Jun. 14, 2010, and published in English on Dec. 23, 2010, as International Publication No. WO 2010/146340 A2, which application claims priority to Great Britain Patent Application No. 0910323.5 filed on Jun. 15, 2009, the contents of both of which are incorporated herein by reference.

BACKGROUND

Deflagrating propellant explosives, such as blackpowder and smokeless powders, which generate a large volume of hot gas when burnt, and produce it very rapidly when under such confinement as is provided by a gun barrel, have been used for many centuries as the means of projecting bullets, cannon balls and shells. High explosives, developed during the nineteenth century, provide the means of projecting metal objects without the need for a barrel since, upon detonation, they evolve gas so quickly that extremely high pressures can be generated without any confinement. The rate of decomposition is known as the "detonation velocity" and corresponds approximately to the velocity of sound in the undetonated material.

The fragments of the body of a modern artillery shell are projected by the gases generated by the detonation of high explosives. In this case the confinement of the explosive afforded by the steel body is of less importance than the velocity of detonation of the explosive even without such confinement and the velocity at which the metal fragments are projected depends only slightly upon the confinement. Thus a plate of steel, for example six millimetres thick and applied to the surface of a sheet of high explosive of twice this thickness, might be projected at a velocity of about 0.7 km/sec upon detonation of the explosive. Sandwiching the explosive between two such plates will increase the velocity of the plates to about a kilometre a second by delaying the effluence of the high pressure detonation products and thus maintaining the pressure for longer. This means of enhancing a charge of high explosive is known as "tamping".

In practice such metal plates tend to disintegrate in flight, their integrity being destroyed by the divergent detonation wave and by internally reflected shock waves, although the interposing of a layer of inert buffering material between the explosive and the metal helps to reduce this tendency to break up.

A great advance was made in the usefulness of a thin layer of metal in contact with detonating high explosive with the invention, during the Second World War, of the "shaped charge". In its most commonly encountered form, this consists of a generally cylindrical or conical block of explosive which has the means of initiating a detonation at one end and a conical cavity, of which the base extends substantially across the other end, at the other. This conical cavity is lined by a hollow cone of metal, typically copper, with a wall thickness of one or two millimeters.

Detonation of the explosive causes a wave of extremely high pressure to pass along the outside of the metal cone, advancing from its apex to its base, collapsing it as it goes. This causes an evertion of the inner surface of the metallic cone which is formed into a highly elongated rod along the axis of rotation of the assembly. This is known as the "jet" and it is possessed of a velocity gradient along its length, with the tip travelling significantly faster than the tail. This difference in velocity causes the jet to stretch until it breaks up into short fragments which begin to tumble after it has travelled a distance equivalent to a few charge diameters. So high is the velocity of such a jet that it is able to penetrate the hardest and toughest of armour to a depth equivalent to several charge diameters. The main applications of such charges is the attack and perforation of the sides of armoured vehicles and the "stimulation" of oil wells. In another form of shaped charge the explosive and the metal-lined cavity are essentially linear rather than radially symmetrical with a typically V-sectioned, metal lined, groove formed in the explosive. Such charges are less penetrating than radially symmetrical shaped charges but they make elongate cuts in the target. They are most used for the cutting rather than perforation of targets.

A second form of metal-projecting high explosive charge is the "explosively formed projectile" or EFP. This is similar to the jet-forming shaped charge except that the metal liner is either in the form of a cone of so wide an angle that it produces no jet, or of a shallow dish. Such projectiles are deformed to greater or lesser degrees and take shapes varying from shallow dishes of only slightly smaller diameter to the unformed projectile to rods with explosively forged tail fins or cones. Simple versions of such charges constitute many of the improvised stand-off weapons used to attack passing armoured vehicles and commonly referred to as "a category of roadside bomb".

Gun barrel technology has been used since the 1980's for the projection of water at high velocity (about 350 m/s) for the purpose of breaking up improvised bombs without causing the detonation of the explosive which they contain. Water as a projectile for this purpose has the advantages of great dispersive power of the bomb components, a high specific heat and great wetting ability, which tend to quench incipient deflagration, and, compared with metals, a low density, which decreases the probability of initiating sympathetic detonation of the target explosive.

The velocity at which projectiles can be shot from gun barrels is subject to the law of diminishing returns in that the power and size of a gun has to be increased disproportionately in order to attain a modest increase in projectile velocity. This means that disruptors based upon gun barrel technology can be readily defeated by constructing a bomb using a moderately robust case or simply a case of sufficient volume to absorb the energy of the bursting water projectile.

Previous inventions of one of the authors (SCA) had as their purpose the generation of jets of water, of aqueous solutions, or of other liquids, using detonating explosives. These devices used modified shaped charge technology. In one family of such charges the metal liner of conventional radially symmetrical or linear shaped charges was replaced by a liner of liquid: in another the cavity in the explosive was largely or completely filled with liquid. These jets of water achieved velocities several times higher than those generated by propellant explosives fired in gun barrels; they also had the concomitant advantages of much lower weight and much lower cost. The velocity of such jets could, moreover, be largely determined by the ratio of explosive to projected liquid. Of particular value are versions of such charges in which both explosive and projected liquid are loaded into flask-like plastics housings by the operator since this enables the amount of explosive used and the ratio of explosive to projected fluid to be determined by the operator. Acquisition, transportation and storage of the empty plastics vessels is also independent of regulations pertaining to explosive-filled devices.

It will be understood that all of these devices required the imparting of particular shapes to the explosive charge since it is the carefully contrived concavity of the explosive itself which determines the direction in which the projectile fluid is projected. U.S. Pat. No. 6,269,725 teaches the construction of a "fluid-filled bomb-disrupting apparatus" known as the "Hydra-Jet" which uses a square-sectioned plastics jar in which the explosive element consists of two rectangular sheets of explosive, contiguous along one edge of each, with an adjustable angle between the two. The explosive element is immersed in water contained in the jar with the mid-line plane between the two sheets of explosive passing through the vertical mid-line of one side of the jar. Upon detonation, a linear jet of water is projected outwards in this plane.

According to a first aspect of the present invention there is provided a liquid-jacketed disrupter comprising a container for receiving liquid and housing a receptacle for explosive material, in which the container comprises one or more indentations which result in the generation of liquid jets upon detonation.

The container may be generally cylindrical.

The or each indentation may be a concavity. For example, the or each indentation may be arcoid in transverse section.

The radius of curvature of the concavity may be substantially the same as adjacent convex surfaces of the container.

There may be two or more indentations.

The indentation may comprise a groove, dimple or the like, for example a longitudinal groove in the container wall.

One object of the invention is the generation of jets of liquid travelling at high velocity using energy derived from the detonation of elements of high explosive. Another object is to use elements of high explosive which have such simple shapes as may be easily confected by the operator in the field. Such explosive elements might thus consist of one or more lengths of detonating cord or of a thin-walled plastics tube into which the operator tamps plastic explosive. Directionality of part or parts of the explosively projected water is imparted by particular shaping of the container of the projected liquid rather than of the explosive.

According to a second aspect of the present invention there is provided a liquid-jacketed disrupter comprising a container for receiving liquid and housing a receptacle for explosive material, in which the receptacle comprises an interchangeable cartridge such that cartridges with different volumes can be used in conjunction with the container.

The disrupter may be provided in combination with a set of two or more cartridges having different volumes which can be selectively received in the container.

The container and receptacle may be provided with co-operating formations for securely retaining the receptacle. The formations may comprise screw thread formations.

Aspects of the present invention may be provided in the same disrupter.

The present invention will now be more particularly described, by way of example, with reference to the accompanying drawings, in which.

Figure 8:
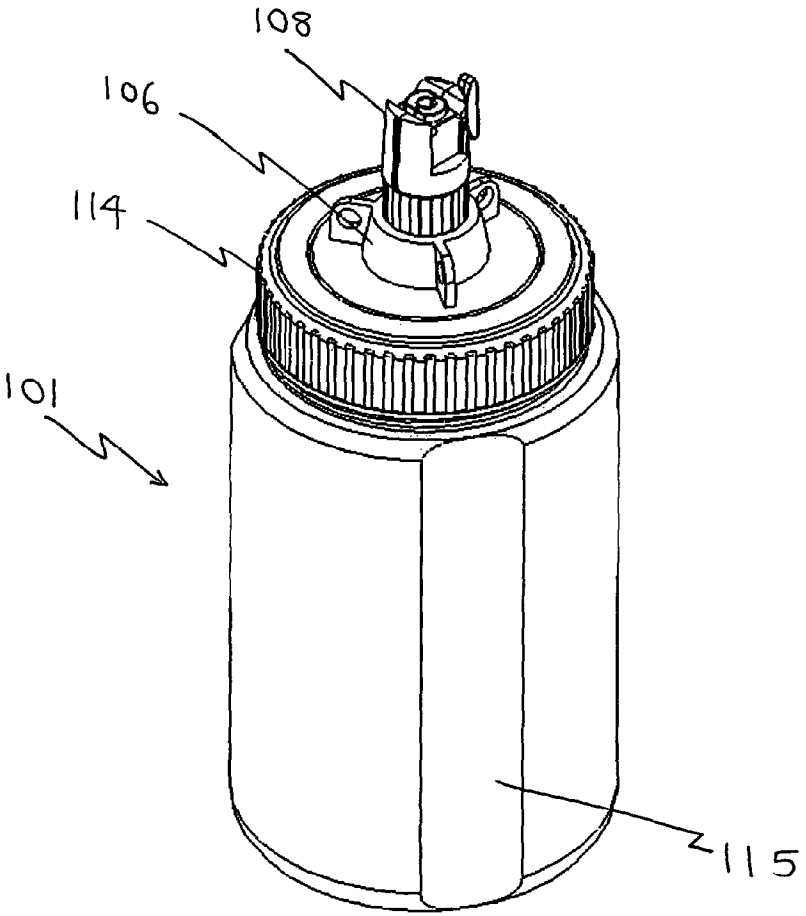
FIG. 8 is a perspective view of a disrupter formed in a manner generally consistent with the container of FIG. 6.
Figure 10:
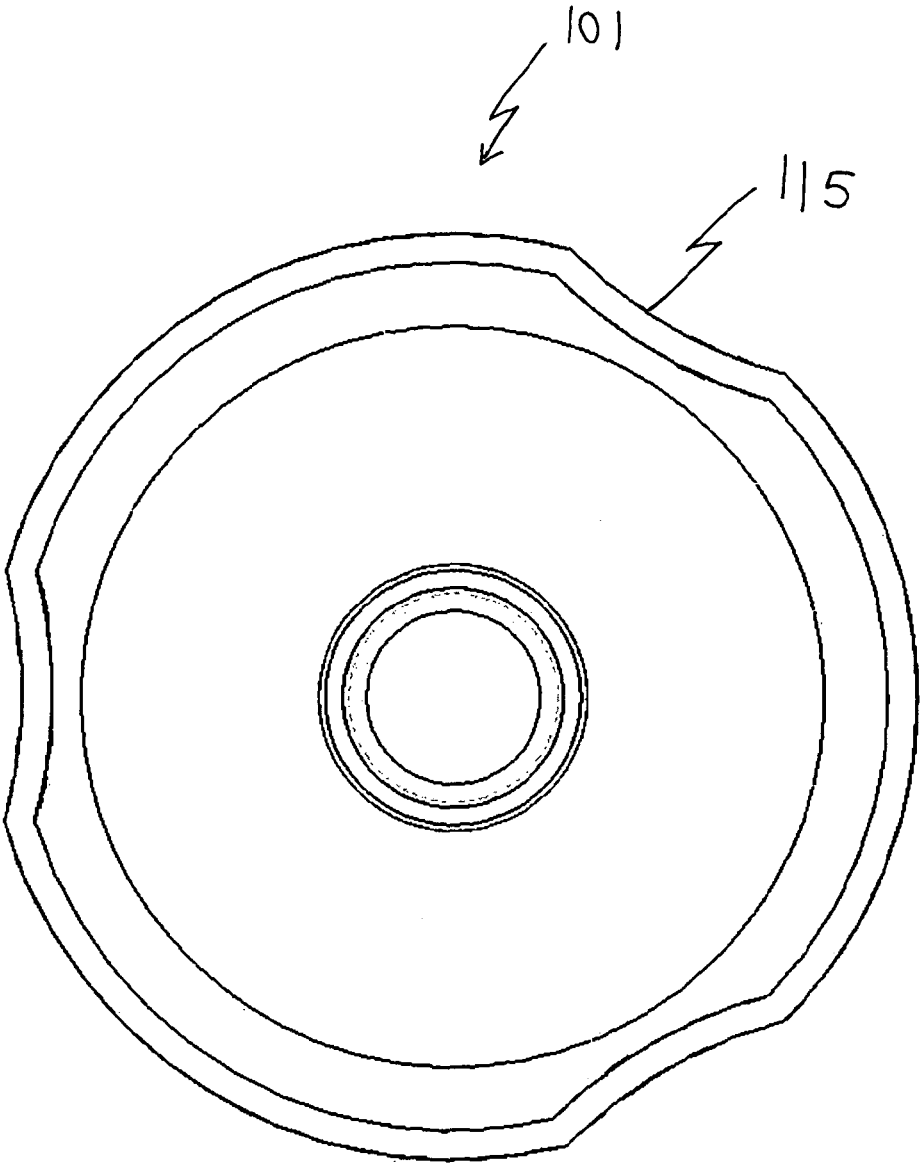
FIG. 10 is a plan view of the disrupter of FIG. 8.
Figure 12:
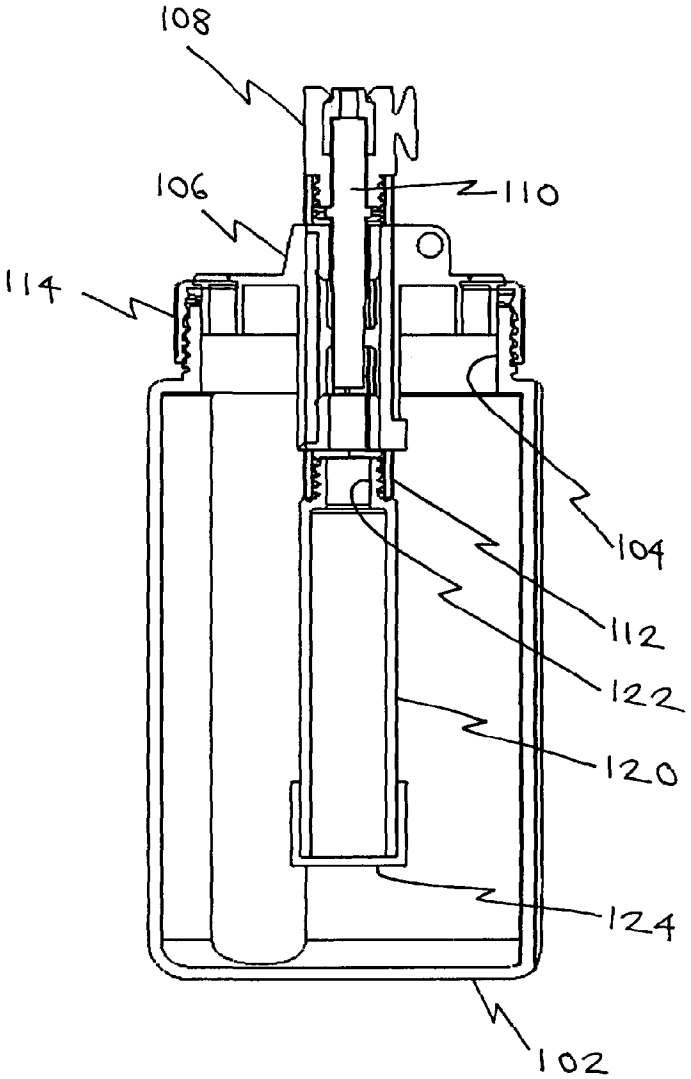
FIG. 12 is a section of the disrupter of FIG. 8.
Figure 11:
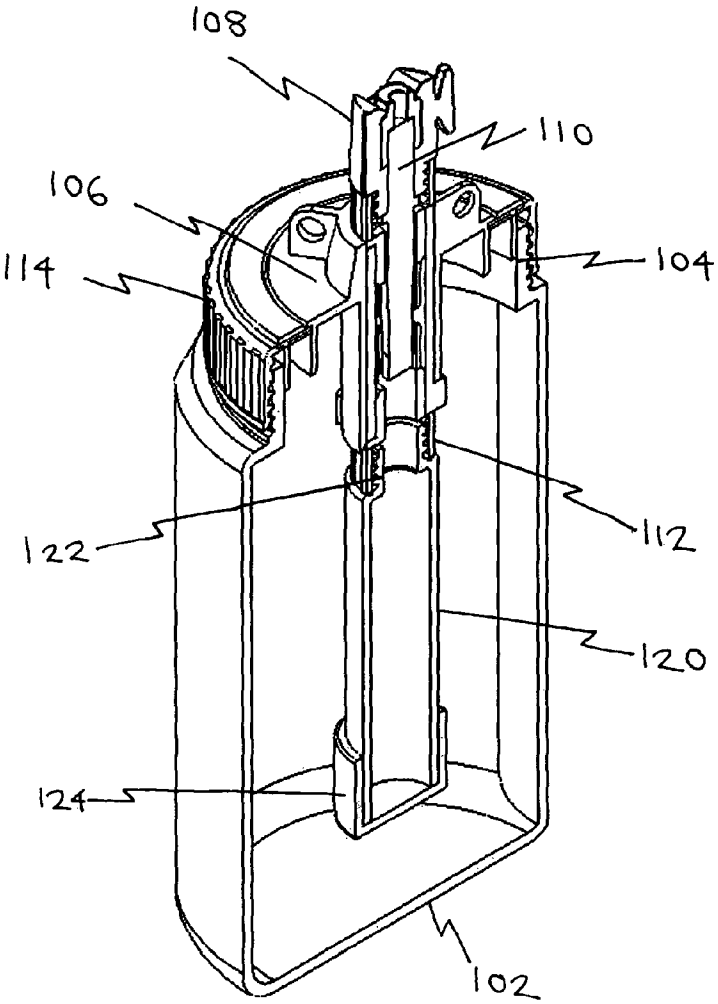
FIG. 11 is a perspective section view of the disrupter of FIG. 8.
Figures 13A, 13B, 13C:
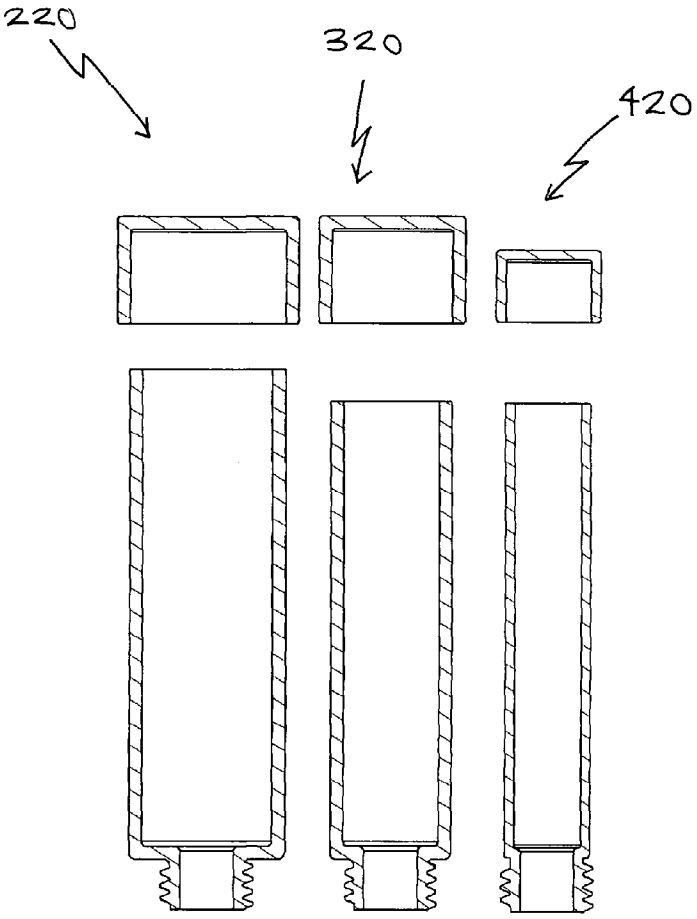

FIGS. 13*a* to 13*c* show three cartridges forming a set for use with the disrupter of FIG. 8.

The Invention comprises or consists of a vessel of liquid, which is most commonly water or a mixture of water with a substance capable of lowering the freezing point of the water, and a mass of explosive situated within this body of liquid. The shape of the explosive element may be compact, such as an approximation to a sphere or elongate, consisting of a strip of explosive with or without an internal stiffening component such as a plastics rod, or an external stiffening and shaping element such as a plastics tube. It may conveniently comprises, or consist of, one or more strands of detonating cord. The explosive element, of whatever shape, is not provided with any significant indentations or folds.

The vessel containing the liquid, in which the explosive element is immersed, is conveniently made from plastics and may, in the case of an approximately spherical mass of explosive, be itself approximately spherical and be provided with one or more indentations. If the Invention is confected using a generally rod-like explosive element, then the liquid-containing vessel may be generally cylindrical or prismatic with the explosive situated along, or parallel to, the long axis of the vessel. At one or more positions in the wall of the plastics vessel a longitudinal groove is formed. Alternatively, generally round indentations may be formed in the wall of the vessel at one or more places.

When the explosive is detonated, the expanding shock-wave which it generates impels the liquid elements close to the indentations or grooves radially outwards and forms them into jets which travel at a higher velocity than that part of the liquid not adjacent to an indentation or groove.

DETAILED DESCRIPTION OF THE INVENTION

Referring now to the Figures.

Figure 1A:
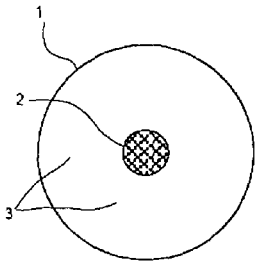
FIG. 1 shows a transverse section of a cylindrical container of liquid with an axial explosive element.
Figure 1B:
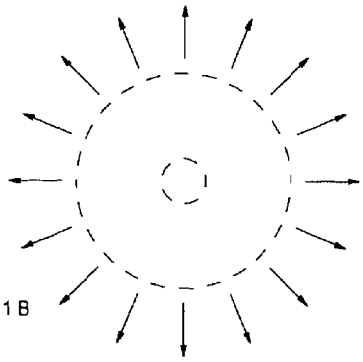

FIG. 1 shows the cross-section of a cylindrical container 1 along the longitudinal axis of which runs a cylindrical charge of high explosive 2. The remaining space 3 within the container 1 is filled with a liquid. This liquid may advantageously be water but other suitable liquids may also be employed. Since the ratio of the mass of projected liquid propelled by the corresponding mass of explosive (the M/C ratio) is constant for all radial increments, the initial velocities of all radial increments of water are similar so no jet formation occurs. It may be seen how water is projected with equal impetus in all radial directions.

Figure 2A:
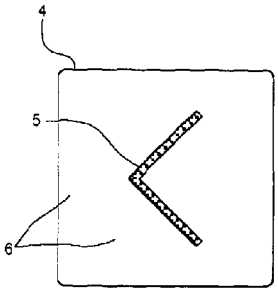
FIG. 2 shows a transverse section of a rectangular container of liquid in which is immersed a chevron-sectioned explosive element.
Figure 2B:
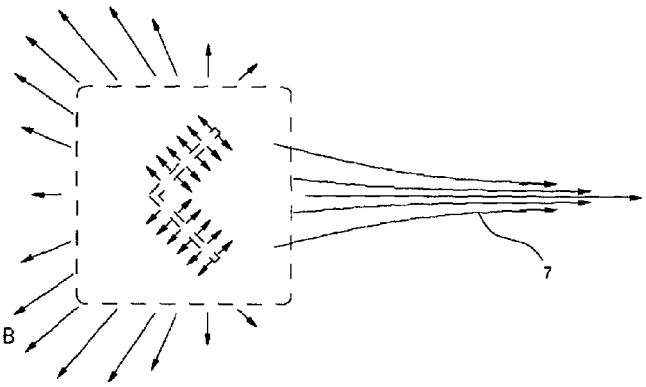

FIG. 2 shows the cross-section of a container 4, square in transverse section, with a chevron-sectioned explosive element 5 place approximately in the centre. It illustrates how the displacement of the liquid in a directional normal to the surfaces of the explosive element 5 results in generation of a focussed jet 7 of liquid whose velocity, which is denoted approximately in proportion to the illustrative arrow length, significantly exceeds that of the liquid projected in other directions.

Figure 3A:
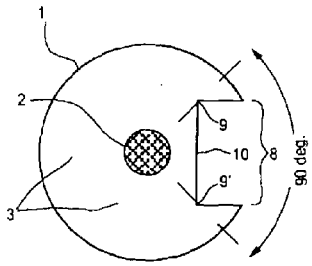
FIG. 3 shows a transverse section of a cylindrical container of liquid with an axial explosive element, said container being provided with a single straight-sided and flat-bottomed slot.
Figure 3B:
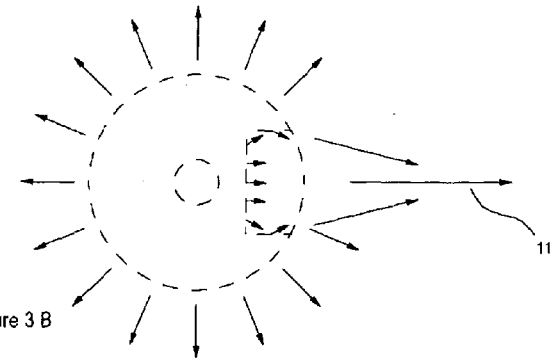

FIG. 3 shows the cross-section of a cylindrical container 1 along the longitudinal axis of which runs a cylindrical charge of high explosive 2. The wall of container 1 is provided with a rectangular-sectioned longitudinal slot 8. The width of the slot 8 is such that its inner corners 9, 9' lie in the planes defining a quadrant. The ratio of the volume of explosive to the volume of liquid upon which it is acting at points along the mid-line 10 of the slot 8 is approximately twice that of the corresponding ratio at points along the edges 9, 9' of the slot 8 and three times that at other points on the cylindrical surface of the container 1. This implies that the liquid between the explosive charge and the bottom of the slot 8 will be propelled outwards at a much higher velocity than will the greater part of the rest of the liquid which is in that part of the container outside the quadrant. Moreover, since the liquid ejected from the base of the slot is less constrained by adjacent liquid on the side of the mid-line 10 of the slot 8 than on the sides of the slot 8, the liquid projected from the bottom of the slot 8 will be generally focussed towards the plane passing through the mid-line 10. This results in the formation of a linear jet 11.

Figure 4A:
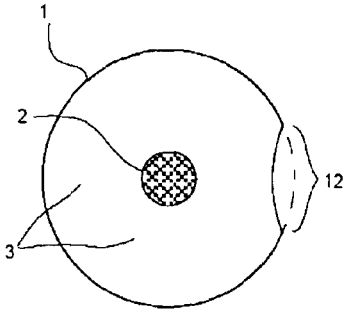
FIG. 4 shows a transverse section of a cylindrical container of liquid with an axial explosive element, said container being provided with a single arcoid-sectioned elongate groove.
Figure 4B:
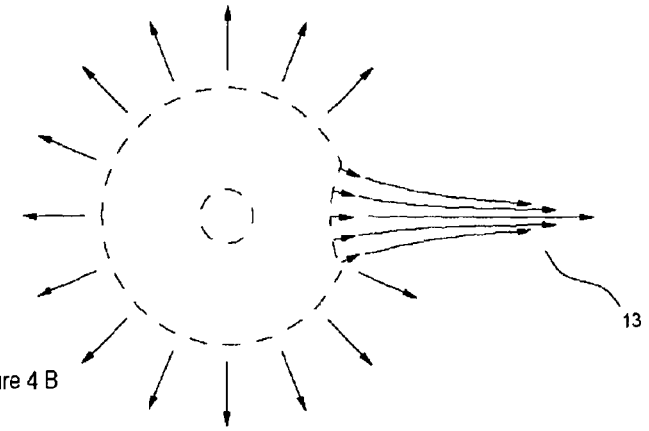

FIG. 4 shows the cross-section of a cylindrical container 1 along the longitudinal axis of which runs a cylindrical charge of high explosive 2. The wall of container 1 is provided with a longitudinal groove 12 which is arcoid in section and which has the same radius of curvature as the container 1. It will be understood that neither the width and depth of this groove, nor its precise cross section, are critical to the performance of the invention. Detonation of the explosive 2 results in the generation of an elongated jet 13 of liquid with a high velocity.

The mechanism of jet formation may be considered to be related to the observation of Charles Munroe in 1888 that a block of explosive with a flat surface which bore indented lettering, when detonated with this surface in contact with a metal plate, imparted an accurate reproduction of this indentation accurately to the metal. In this case it was the detonation wave arriving at the indented surfaces of the explosive itself which projected the shockwave, focussed by the engraved lettering, which produced the effect on the metal: in the present case it is believed that the intense shockwave generated by the explosive element and transmitted through the liquid content of the container contributes to the jet generation by an analogous directional spalling of the outer increments of liquid. More liquid will be projected in the wake of this leading projectile material as the explosively generated gaseous decomposition products expand.

Figure 5:
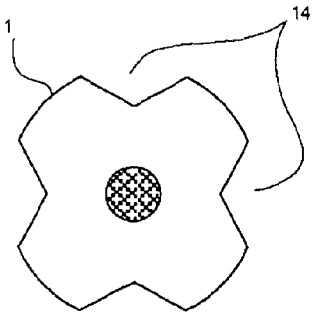
FIG. 5 shows a transverse section of a cylindrical container of liquid with an axial explosive element, said container being provided with four equally spaced angular grooves.

FIG. 5 shows the cross-section of a cylindrical container 1 of which the wall is provided with a series of four angled and equally spaced grooves 14 round its circumference. It should be understood that increasing the number of such grooves or widening the grooves eventually decreases the confining effect of the liquid adjacent to each groove and such jets as are formed are of correspondingly reduced velocity and hence penetrating or disruptive power.

Figure 6:
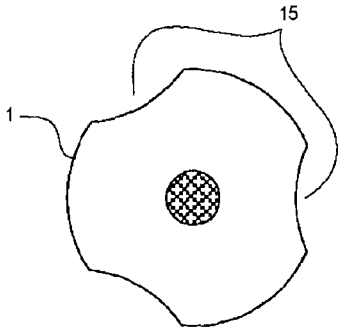
FIG. 6 shows a transverse section of a cylindrical container of liquid with an axial explosive element, said container being provided with three equally spaced arcoid grooves.

FIG. 6 shows the cross-section of a cylindrical container 1 of which the wall is provided with a series of three equally spaced rounded grooves 15 round its circumference.

Figure 7:
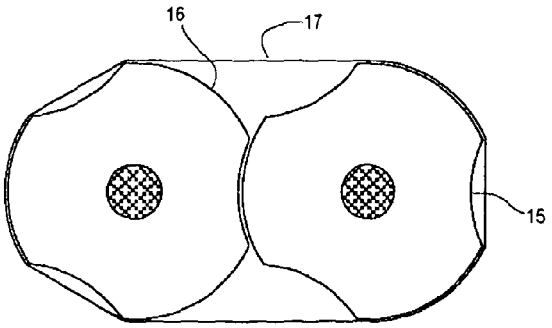
FIG. 7 shows a pair of charges attached together.
Figure 9:
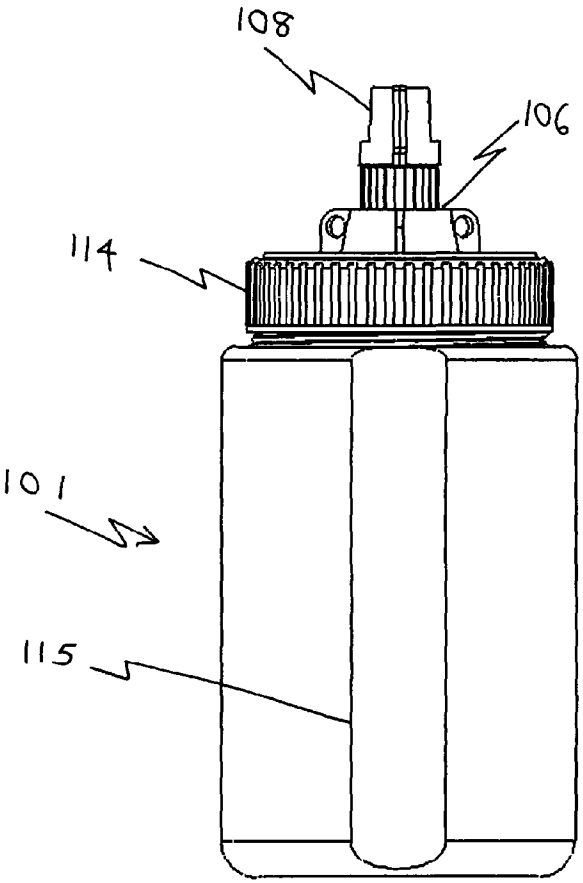
FIG. 9 is a side view of the disrupter of FIG. 8.

FIG. 7 shows an arrangement whereby a pair the charges illustrated in FIG. 6 can be conveniently attached to each other in a rigid manner by first aligning one cylindrical part 16 of the container 1 within a groove 15 of a second container. A single turn of adhesive tape 17 then suffices to attach the two charges firmly together. This provides a convenient and simple means of constructing multiple charges for enhanced total disruptive power.

By way of example of the effectiveness of the disruptive power of jets produced by the Invention, a disruptor was assembled using a plastic bottle similar to that illustrated in FIG. 6. The diameter of the plastics container was 60 mm and its height 100 mm. Each groove was 15 mm wide and 1.6 mm deep. The explosive charge consisted of 10 g of plastic explosive. The plastics container was filled with water.

The charge was placed with one groove directed towards a brass-bound plywood ammunition box with the approximate dimensions 300×230×200 with a closed, hinged lid from a distance of approximately 40 mm. The proximal side of the box was cut vertically and the box disintegrated with all sides separated from the bottom and lid.

When placing a disruptor close to a target by using a remote-controlled vehicle, it is important, if a cutting effect is required of the disruptor, to ensure that a groove in its container is facing towards the target before the vehicle withdraws and the charge is fired. Since the groove is necessarily on the side of the charge distal to, and consequently not visible to, the operator, it is advantageous to provide a brightly coloured stripe on the outside of the container diametrically opposite the groove. A container with more than one groove will be provided with a corresponding number of such coloured stripes so that the correct orientation of the disruptor can be assured immediately before firing.

Referring now to FIGS. 8 to 12 there is shown a disrupter formed according to an alternative embodiment. The disrupter comprises a generally cylindrical container 101 which is closed at one end 102 and at its other end has a screw-threaded mouth 104.

The container 101 has three equally spaced rounded grooves 115 which extend longitudinally along substantially the entire length of the container wall.

The container mouth 104 receives a cartridge mount 106 which at one end receives a split screw 108 that carries a dummy detonator 110. At the other end of the mount is a screw-threaded socket 112 for receiving a cartridge 120.

The mount 106 is dimensioned to sit on top of the mouth 104. A screw-threaded collar 114 fits around the mouth 104 and partially over the mount 106 to hold it firmly in position.

The cartridge 120 comprises a generally cylindrical body open at both ends. At one end of the cartridge 120 is a screw-threaded neck 122 and the other end of the cartridge 120 is closed by a removable end cap 124.

In use, the container 101 is filled with fluid, for example water and explosive material is loaded into the cartridge through the open end which is then subsequently closed by the cap 124. The cartridge 120 is then screwed into the socket 112 and the mount 106 is secured, together with the split screw and pin, to the container using the collar 114.

Referring now to FIGS. 13*a*, 13*b* and 13*c* there are shown three cartridges 220, 320, 420 suitable for use with a container 101 of the type shown in FIGS. 8 to 12. It will be noted that the cartridge 420 is smaller than the cartridge 320 which is in turn smaller than the cartridge 220. Accordingly the cartridges can accommodate different amounts of explosive material. By providing the facility for explosive material cartridges with different volumes it is possible for the cartridge to be filled to achieve a required amount of explosive material. It is anticipated that this will lead to less instances where more explosive material than is strictly necessary is used. In addition, in this embodiment the cartridges are formed from relatively thin-walled plastics material and this allows for the possibility of chopping off part of the length of the cartridge to reduce the amount of explosive material in a fully loaded cartridge; thereafter the end cap can still be placed over the cut end.

The invention claimed is:

1. A liquid-jacketed disrupter comprising a container configured to receive liquid and house a receptacle for explosive material, and in which (i) the receptacle is a cartridge into which explosive material is loaded in use and (ii) the container (A) comprises one or more longitudinal grooves which result in the generation of liquid jets upon detonation of the explosive material, (B) is generally cylindrical defining a longitudinal axis, (C) is closed at one end, and (D) has a mouth at its other end, the disrupter further comprising a mount receivable by the mouth for securely retaining the cartridge so as to run along the longitudinal axis.

2. A disrupter as claimed in claim 1, in which the container includes a container wall and at least one longitudinal groove is formed in the wall.

3. A disrupter as claimed in claim 1, in which the container comprises three or four grooves.

4. A disrupter as claimed in claim 1, in which the receptacle is received generally centrally within the container.

5. A disrupter as claimed in claim 1, in which the receptacle comprises an interchangeable cartridge such that cartridges with different volumes can be used in conjunction with the container.

6. A disrupter as claimed in claim 5, in combination with a set of two or more cartridges having different volumes which can be selectively received in the container.

7. A disrupter as claimed in claim 5, in which the container and receptacle are provided with co-operating formations for securely retaining the receptacle.

8. A disrupter as claimed in claim 7, in which the formations comprise screw thread formations.

9. A disrupter as claimed in claim 1, in which the cartridge has a removable end cap.

10. A disrupter as claimed in claim 1, in which the cartridge has a screw threaded neck.

11. A disrupter as claimed in claim 1, in which the mouth is screw threaded.

12. A disrupter as claimed in claim 1, further comprising a screw threaded collar.

13. A disrupter as claimed in claim 1, in which the container is formed of a plastics material.

14. A disrupter as claimed in claim 1, in which the cartridge is generally cylindrical.

15. A disrupter as claimed in claim 1, in which the cartridge and the mount have cooperative formations for securely retaining the cartridge.

16. A disrupter as claimed in claim 1, further comprising a collar for securing the mount to the container.

17. A disrupter as claimed in claim 1, in which (a) the container comprises adjacent convex surfaces and (b) at least one longitudinal groove is a concavity whose radius of curvature is substantially the same as that of the adjacent convex surfaces of the container.

18. A disrupter as claimed in claim 1, in which (a) at least one of the longitudinal grooves comprises a concave surface with a radius of curvature, (b) the container comprises one or more convex surfaces having a radius of curvature, (c) at least one convex surface is adjacent the concave surface, and (d) the radius of curvature of the convex surface is substantially the same as the radius of curvature of the concave surface.

19. A disrupter as claimed in claim 18, in which the container comprises a plurality of convex surfaces and a plurality of concave surfaces alternating around the container.

* * * * *